US008683630B2

(12) United States Patent
Rolfes

(10) Patent No.: US 8,683,630 B2
(45) Date of Patent: Apr. 1, 2014

(54) DURABLE CONNECTOR FOR BASE UNIT HANDLE OF A PATIENT HEAD SUPPORT SYSTEM

(75) Inventor: Sean Rolfes, Cincinanti, OH (US)

(73) Assignee: Integra LifeSciences Corporation, Plainsboro, NJ (US)

( * ) Notice: Subject to any disclaimer, the term of this patent is extended or adjusted under 35 U.S.C. 154(b) by 302 days.

(21) Appl. No.: 13/280,902

(22) Filed: Oct. 25, 2011

(65) Prior Publication Data

US 2012/0260429 A1 Oct. 18, 2012

Related U.S. Application Data

(60) Provisional application No. 61/475,795, filed on Apr. 15, 2011.

(51) Int. Cl.
*A61G 13/12* (2006.01)
*A47C 20/00* (2006.01)

(52) U.S. Cl.
USPC ..... 5/622; 5/637

(58) Field of Classification Search
USPC ..... 5/622, 637, 640, 643; 403/97, 148, 190, 403/191, 234, 235, 320, 409.1; 128/845; 602/17
See application file for complete search history.

(56) References Cited

U.S. PATENT DOCUMENTS 525,171 A * 8/1894 Whayne ..... 403/191
1,215,145 A * 2/1917 Gustafson et al. ..... 403/191
1,239,543 A * 9/1917 Tipton ..... 403/148
3,572,835 A * 3/1971 Kees et al. ..... 297/410
4,805,634 A 2/1989 Ullrich et al.
5,269,034 A 12/1993 Day et al.
5,320,628 A 6/1994 Ufkin
5,380,336 A 1/1995 Misko et al.
5,537,704 A 7/1996 Dinkler
5,560,728 A * 10/1996 McFadden ..... 403/53
5,564,663 A 10/1996 Cook et al.
5,634,929 A 6/1997 Misko et al.
7,093,313 B2 * 8/2006 DeBraal et al. ..... 5/622
7,544,007 B2 6/2009 Easton
7,552,492 B2 6/2009 Rolfes et al.
7,836,532 B2 * 11/2010 Schule ..... 5/622
8,286,283 B2 * 10/2012 Copeland et al. ..... 5/621
2008/0072381 A1 3/2008 Rolfes et al.

* cited by examiner

*Primary Examiner* — Michael Trettel

(74) *Attorney, Agent, or Firm* — Wood, Herron & Evans, LLP

(57) ABSTRACT

A patient head support system comprises a base unit, a head support, and an intervening member for connecting the base unit and the head support. The base unit includes a handle assembly with an elongated body, a bore at one end thereof, and a lever that moves relative to the body between closed and open positions to contract and to expand the bore, respectively. A sleeve retained within the bore is sized to receive and hold a shaft of the intervening member, so as to hold the intervening member in a fixed position when the lever is closed. The sleeve remains retained in the bore when the transition member is disconnected, to resist contracting of the bore caused by inadvertent closing of the lever when the intervening member is unattached, and to protect against the unwanted intrusion of material into the bore.

22 Claims, 5 Drawing Sheets

DURABLE CONNECTOR FOR BASE UNIT HANDLE OF A PATIENT HEAD SUPPORT SYSTEM

RELATED APPLICATION

The present application claims priority to U.S. Ser. No. 61/475,795 filed Apr. 15, 2011, the disclosure of which is incorporated herein by reference in its entirety.

FIELD OF THE INVENTION

The present invention relates to a patient head support system suitable for use during neurosurgery, and more particularly, to an improvement related to connecting the base unit handle to another component.

BACKGROUND OF THE INVENTION

Patient head support systems for securing the head of a patient during surgical or radiological procedures are known in the art. Such head support systems typically include a base unit that connects to a patient table, a skull clamp or headrest that holds a patient's head, and intervening structure for interconnecting the base unit to the skull clamp or headrest. These components, namely, the base unit, the intervening structure, and the skull clamp or headrest, adjust so the head of the patient may be secured in any one of a number of different positions, either for a particular radiological view or to facilitate access to a patient's head during a surgical procedure.

Typically, the base unit has two legs that connect to a table, a crossbar that extends between the two legs, and a base unit handle. The base unit handle has an elongated body that connects to the crossbar at a first end of the elongated body. The other end of the elongated body connects to an intervening member, such as a transition member or an adaptor, which in turn supports a skull clamp or headrest that holds the patient's head. These components, i.e. the skull clamp or headrest and the one or more intervening members, along with the base unit handle, enable operating room attendants to adjust the height, distance, and orientation of the skull clamp or headrest with respect to the end of the table, to hold the patient's head in a desired position.

For such head holding systems the intervening member, typically a transition member or an adaptor, has a cylindrically shaped post, or shaft, that is sized to be received within a complementary shaped bore at the second end of the elongated body of the base unit handle. The base unit handle has a lever that moves to and from the elongated body to contract and to expand, respectively, the diameter of the bore. With the lever moved to a closed position, adjacent the elongated body, the contracted diameter of the bore of the base unit handle rigidly holds the post and hence the intervening member. More specifically, once the intervening member, for example, a 6" transition member, is installed, closing the lever of the base unit handle will, via cam action, exert a force to squeeze the bore tightly against the cylindrical post of the transition member. This creates frictional force to immobilize the base unit handle and the transition member. This frictional force must be sufficient to hold the system in a rigid fixed position, to stably support the patient. This closing of the lever of the base unit handle also closes or clamps the first end of the elongated body to the crossbar.

To function properly, i.e. to supply sufficient rigidity, the bore of the base unit handle and the post of the intervening member depend on very close tolerances. As a result, the surfaces typically used to achieve this lockable bore-on-post connection require a consistent surface finish, to provide smooth movement in the free state and to provide security when locked.

Also, the base unit handle can be damaged by the inadvertent moving of the locking lever into the closed position when the bore is empty. This can cause permanent distortion of the bore due to the compound leverage achieved via the closed lever. This vulnerability can perhaps be better understood with respect to the structure of the elongated body of the base unit handle. More specifically, a slot formed in the elongated body and in communication with the bore allows the elongated body to flex very slightly, so that the bore can constrict when the lever closes, as taught in U.S. Pat. No. 5,564,663. More specifically, the cam linkage of the lever is capable of exerting such a force on this bore structure that it can permanently bend the casting that defines the bore. Once the bore has been bent out of shape, it is highly possible that the post will no longer fit in the bore, at least not with the proper frictional fit.

For these reasons, with this type of head support system, the intervening member should always be connected to the base unit handle with the lever in the open position, such that the post of the intervening member is placed inside the bore and then the lever closed thereafter. Also, a caution warning is usually given to the users of such head support systems, to discourage them from closing the lever of the base unit handle when the bore is empty.

Also, when the lever moves from the locked to the unlocked position, it can accelerate rapidly if it is not being actively controlled by the user. If not controlled the lever will travel to its limit and stop abruptly. There are minor differences from one casting to another. Depending on the casting the lever stops when the linkage cannot move any further, or it stops when the corresponding cam rod strikes the casting. If the linkage stops because the cam rod is striking the casting, the repeated impact of the cam rod actually can push material into the bore.

When this occurs, a bulge of material may intrude into the bore, which can make it difficult or impossible to remove the intervening member. For this reason, in addition to the above described warning to close the lever only when the intervening member is inside the bore, it is also helpful to warn or to encourage such users to actively control the lever during opening, to avoid this striking of the casting by the cam rod. Unfortunately, such warnings are not a failsafe solution to these problems.

In addition to these issues, the outer surface of the cylindrical post of the transition member, when separated from the base unit handle, is susceptible to being marred by careless handling. If such marring occurs to the post, the locking function of the base unit handle can be rendered inoperable. In other words, the bore of the base unit handle and the post of the transitional member are in some respects very susceptible to mishandling by surgical attendants, and such mishandling can result in inoperability of the head support system.

To some extent these issues are complicated by the consideration that clinicians will want to be able to connect the intervening member to the base unit on either the right side or on the left side, depending on the circumstances, so that the intervening member can be removed from the base handle unit and switched around to face the other direction, when the opposite orientation is required. Clinicians are accustomed to this degree of flexibility in the surgical theatre, and any reduction in this capability would not be acceptable.

It is an object of the present invention, with respect to patient head support systems, to eliminate the potential for inadvertently damaging the portion of the base unit handle that forms or defines the bore.

It is another object of the present invention to assure consistency and repeatability in achieving an immobilizing force between the bore of a base unit handle and an intervening member of a patient head support system.

It is still another object of the present invention to assure a long-lasting, consistent and robust connection of the components of a head support system, without diminishing the degree of flexibility currently achieved by existing components.

It is still another object of the invention to preserve and to protect the structure and operability of a base handle unit, in a manner that relies less on operator instructions and warnings, and more on the structure itself.

SUMMARY OF THE INVENTION

The present invention achieves these objects by retaining a sleeve, or bushing, within the bore of a base unit handle, the sleeve having an external surface that cooperates with the interior surface of the bore, and an internal surface that cooperates with a post, or shaft, of an intervening member. The sleeve supplies resistance to the closing force of the lever of the base unit handle. Because the sleeve remains in the bore, this structure eliminates problems related to the inadvertent closing of the lever when the bore is empty. More specifically, this structure eliminates the damage that would otherwise be caused to the bore of the base unit handle upon inadvertent closing of the lever. It also enables a relaxing of the tolerances of the structures used to hold the intervening member to the base unit handle.

Essentially, the sleeve serves as a connector between the base unit and the intervening member, such as an adaptor or a transition member, which in turn supports the skull clamp or headrest. When retained in place as part of a base unit handle, the sleeve protects the delicate surfaces of the bore from distortion and abrasion that could result from careless treatment.

According to one aspect of this invention, the sleeve and intervening member provide the connection security of a positive clutch, combined with the infinite positioning of a lockable sliding joint. More specifically, the sleeve or bushing carries a pair of clutch mechanisms, such as ratchet teeth or starburst connectors, at each of its opposite ends. These ratchet teeth are operable to selectively engage a complementary starburst on a protrusion of the intervening member, typically a transition member. These connectors enable the sleeve to be independently secured to the transition member. This can occur, for instance, by threadably securing the post of the transition member into the sleeve, via external threads on the post that complement internal threads of the sleeve. This combination of a threaded connector and the opposed starburst connection allows the transition member and sleeve to be independently connected, so as to be rotatable relative to the bore when the lever is open. But when the lever moves from an unlocked to the locked position, the sleeve and the transition member become fixed in position relative to the bore.

The sleeve's circumferential external surface mimics the outer cylindrical surface of a conventional transition member, so that it will rotate freely in the bore when the lever is open, or unlocked, and be gripped tightly when the lever is closed, or locked. This structure allows non-incremental rotation of the sleeve and the transition member within the bore. The sleeve is sized and/or shaped so as to provide some resistance to contraction of the bore during closing of the lever. The sleeve can be made of any resilient metal, for example, stainless steel, aluminum or titanium, or any other suitable material, including a radiolucent material, if radiolucency is desired. The starburst connectors add to the versatility of this structure. That is, this structure combines non-incremental rotation relative to the base unit handle with the rigidity of a clutch-type connection between the base unit handle and the intervening member, via the starburst connectors. The cooperating ratchets prevent rotation between the transitional member and the sleeve so that they move (or are immobilized) as a single unit when they are fastened together.

Also, the sleeve includes a central circumferential groove in its outer surface. This helps to prevent the sleeve from binding rotationally if the cam rod deforms the casting.

In summary, the present invention eliminates the potential for damaging the portion of the base unit handle that defines the bore. This invention achieves consistency and repeatability in achieving an immobilizing force between a base unit handle and an intervening member. Moreover, this invention achieves a robust connection of head supporting components without sacrificing any flexibility. Also, the centrally located groove of the sleeve can, to some extent, accommodate any central bulging of material into the bore that might be caused by the cam rod, if the operator does not actively control movement of the lever.

These and other features and advantages of the present invention will be more readily understood from the following detailed description of the invention, when considered in conjunction with the accompanying drawings, which are briefly described below.

DETAILED DESCRIPTION OF THE PREFERRED EMBODIMENT

Figure 1:
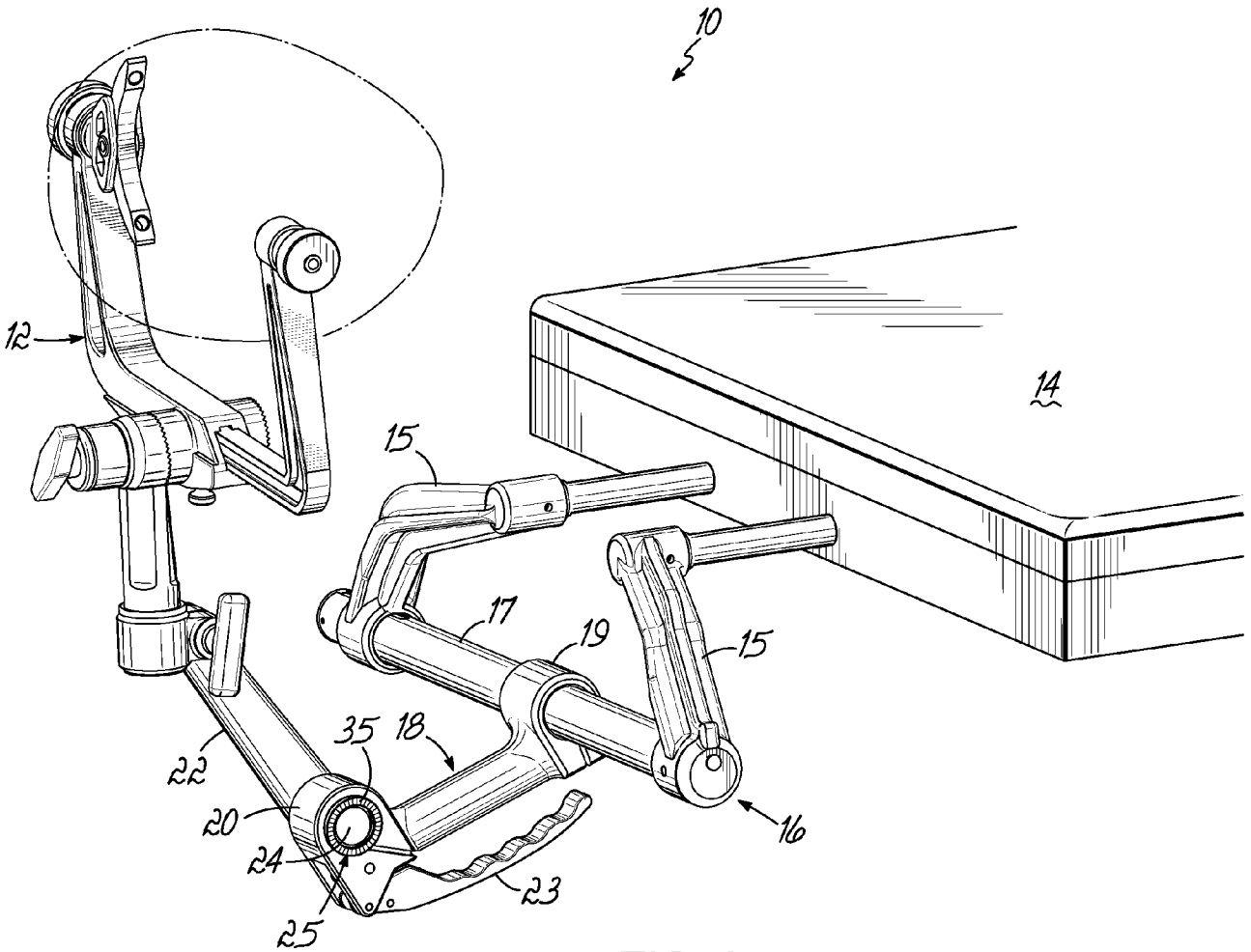
FIG. 1 is a perspective view of a patient head support system, including a base unit, a transition member, and a skull clamp, wherein the base unit includes a base unit handle equipped with a sleeve, according to a first preferred embodiment of the invention.

FIG. 1 shows a head support system 10 for supporting a patient (head shown in phantom) via a skull clamp 12 at the end of a surgical table 14. According to the arrangement of components shown in FIG. 1, in addition to the skull clamp 12, the head support system 10 includes a base unit 16, which includes a crossbar 17 that spans between a pair of spaced connector legs 15, and a base unit handle 18. The legs 15 connect to the table 14 and support the crossbar 17. The base unit handle 18 has a first end 19 that connects to the crossbar 17 and a second end 20 that connects to a transition member 22. The transition member 22 operatively connects the skull clamp 12 to the base unit 16. In this example, the transition member 22 serves as an intervening member. Those skilled in the art will readily appreciate that one or more adaptors or transition members could be used as the intervening member, or members, for interconnecting the base unit 16 and the skull clamp 12.

The focus of this detailed description is on the connection between the transition member 22 and the base unit handle 18, particularly when a post, or shaft 24 of the transition member 22 is received within a bore 27 of the base unit handle 18, and a lever 23 of the base unit handle 18 is closed to a locked position. One conventional structure for a base unit handle is shown in U.S. Pat. No. 5,564,663, entitled "Transitional Pivot Joint For Head Support Base Unit," which is expressly incorporated herein by reference in its entirety. The present invention incorporates a sleeve 25, or bushing, into the cylindrical bore 27 of the base handle unit 18. Thus, it is the sleeve 25 that interconnects the base unit handle 18 to the intervening member 22. Because the sleeve 25 is retained in the bore 27 (see FIG. 2), the sleeve 25 eliminates damage that could otherwise occur due to the inadvertent closing of the lever 23. As described previously, closing the lever 23 causes the bore 27 to circumferentially contract. With the present invention this closing of lever 23 causes the bore 27 to clamp the outer surface of the sleeve 25, which in turn cooperatively holds the post 24 of the intervening member 22 in place, relative to the base unit handle 18.

Figure 2:
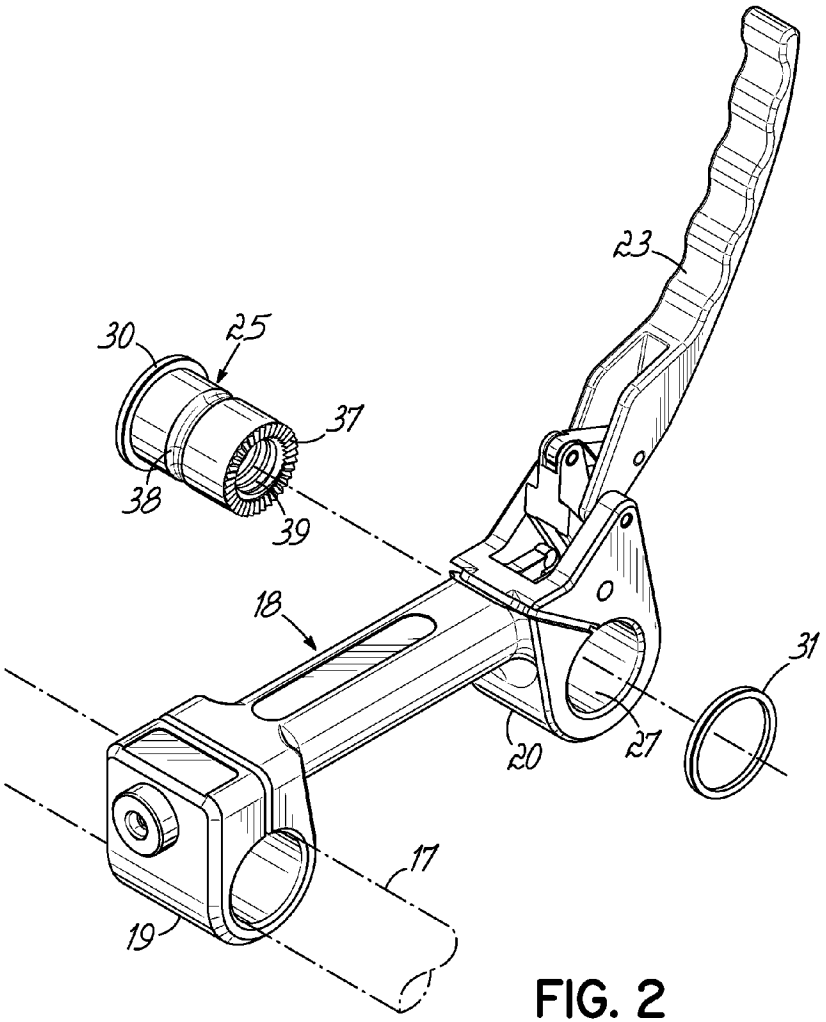
FIG. 2 is a perspective view of the base unit handle shown in FIG. 1, with the sleeve unassembled and with an accompanying retaining ring uninstalled, and with the lever in an unlocked position.

FIG. 2 shows that the sleeve 25 includes an annular groove or depression 38 circumferentially surrounding its outer surface. The groove 38 helps to prevent the sleeve 25 from binding rotationally, if the cam rod deforms the casting.

Figure 3:
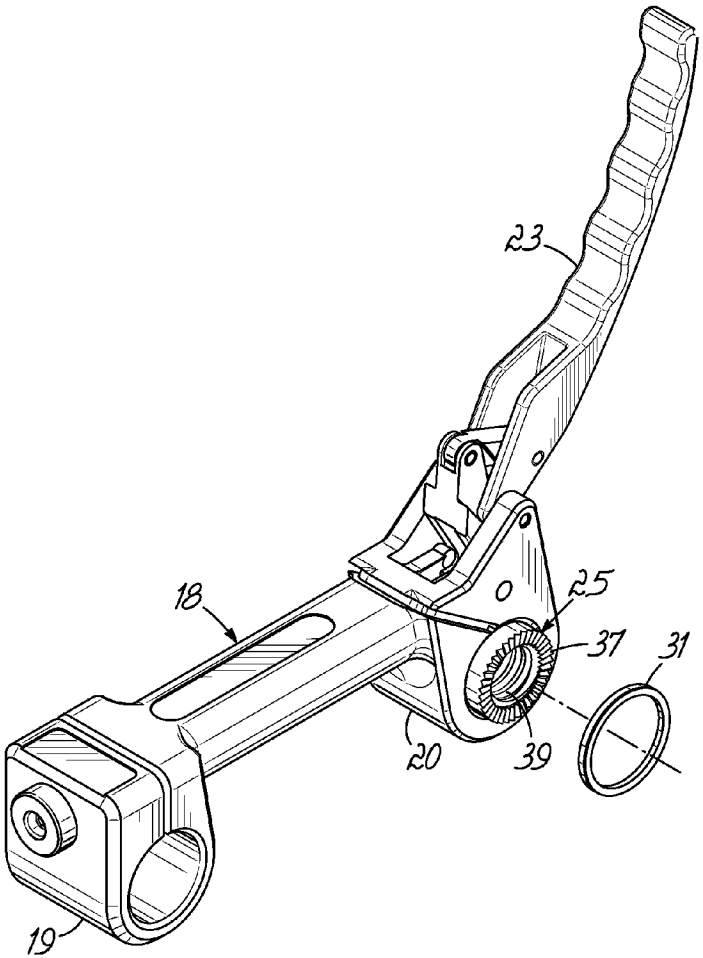
FIG. 3 is a perspective view, similar to FIG. 2, but with the sleeve now located in the bore, with the accompanying retaining ring still uninstalled, and with the lever still in an unlocked position.
Figure 4:
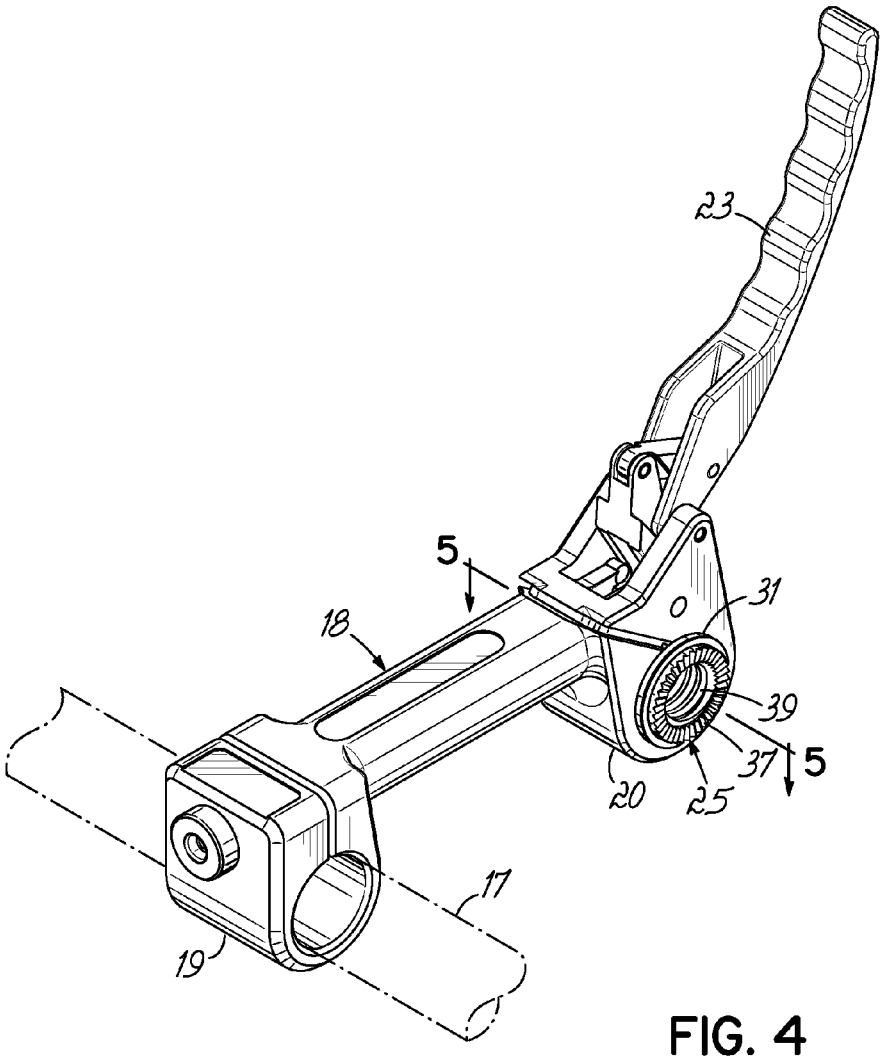
FIG. 4 is an assembled perspective view, similar to FIGS. 2 and 3, with the sleeve located in the bore of the base unit handle, with the retaining ring in place, and with the lever still in an unlocked position.

FIGS. 2-4 show the relative size and shape of the sleeve 25, compared to the bore 27. These Figures show that the sleeve 25 is preferably retained in the bore 27 of the base unit handle 18 by a flange 30 located at one end thereof and a retaining ring 31 removably secured at the other end thereof. Stated another way, the flange 30 and the retaining ring 31 prevent inadvertent removal of the sleeve 25 from within the bore 27. Those skilled in the art will recognize that there are other acceptable ways to retain the sleeve 25 within the bore 27, for instance via alternative structure such as a set screw, an oblique cross pin, or any other analogous holding mechanism, preferably so that the sleeve 25 is retained so as to not bend or bind within the bore 27. With the sleeve 25 retained within the bore 27, the base unit handle 18 is much less vulnerable to damage resulting from careless operation by attendants.

Figure 5:
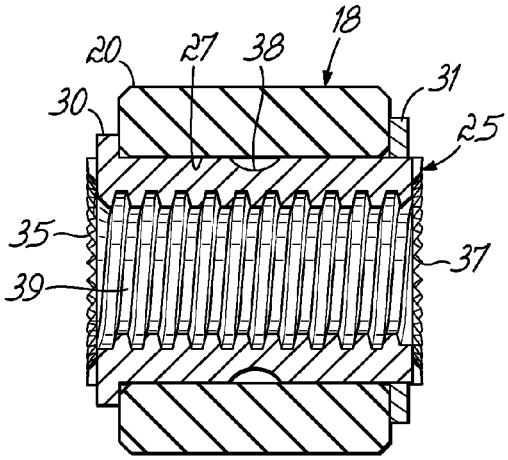
FIG. 5 is a longitudinal cross sectional view, taken along lines 5-5 of FIG. 4, showing the sleeve located in the bore of the base unit handle.

FIG. 5 shows a longitudinal cross sectional view of the sleeve 25 within the bore 27. This view shows the relatively close tolerances between the sleeve 25 and the bore 27. FIG. 5 also shows that sleeve 25 has an internal thread 39 extending therethrough. This internal thread 39 is sized and shaped to accept a complementarily shaped external thread 41 formed on the post 24 of the transition member 22, as shown in FIG. 6.

Figure 6:
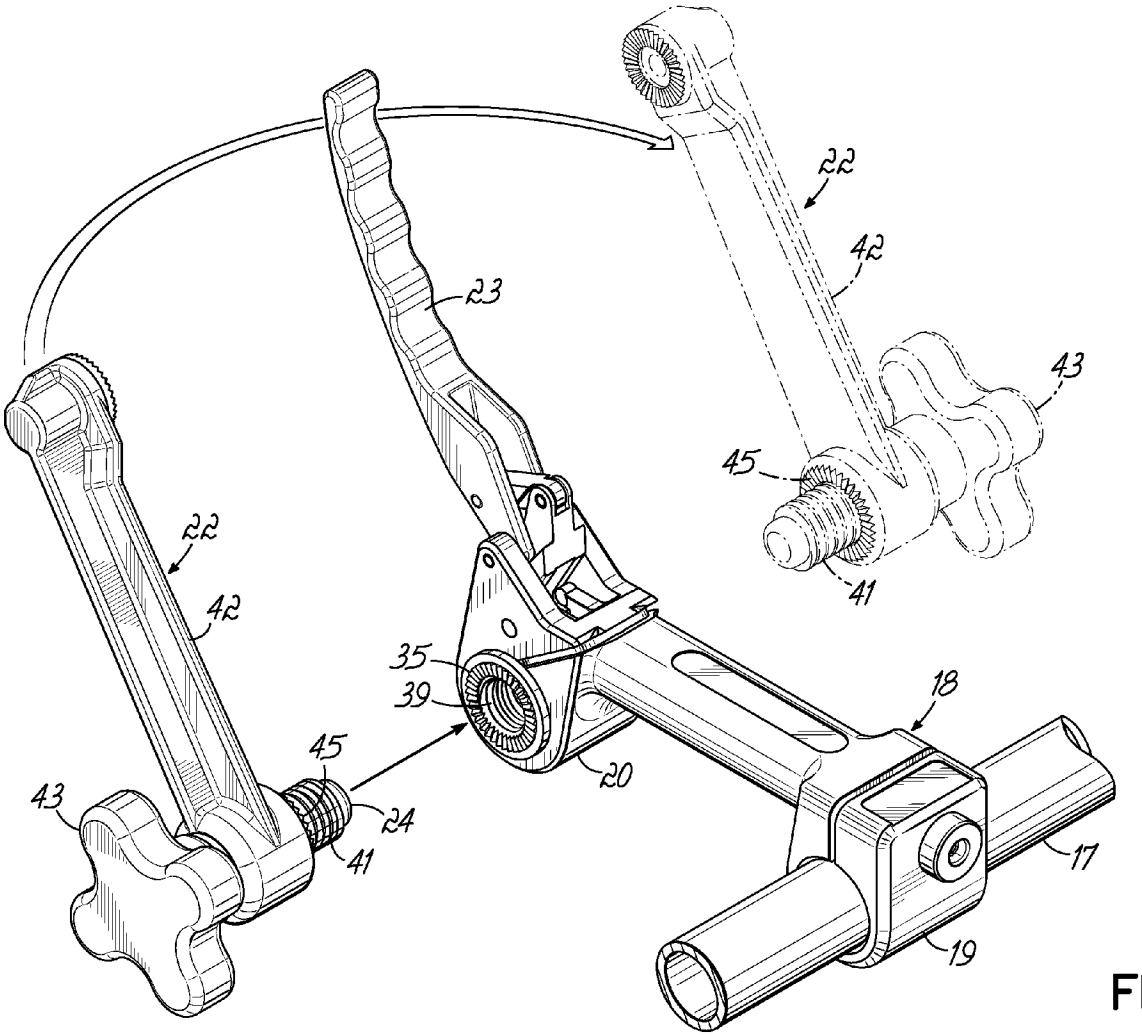
FIG. 6 is a perspective view of the base unit handle shown in FIGS. 2-4, with the sleeve located in the bore, and with the lever in the opened and unlocked position.
Figure 7:
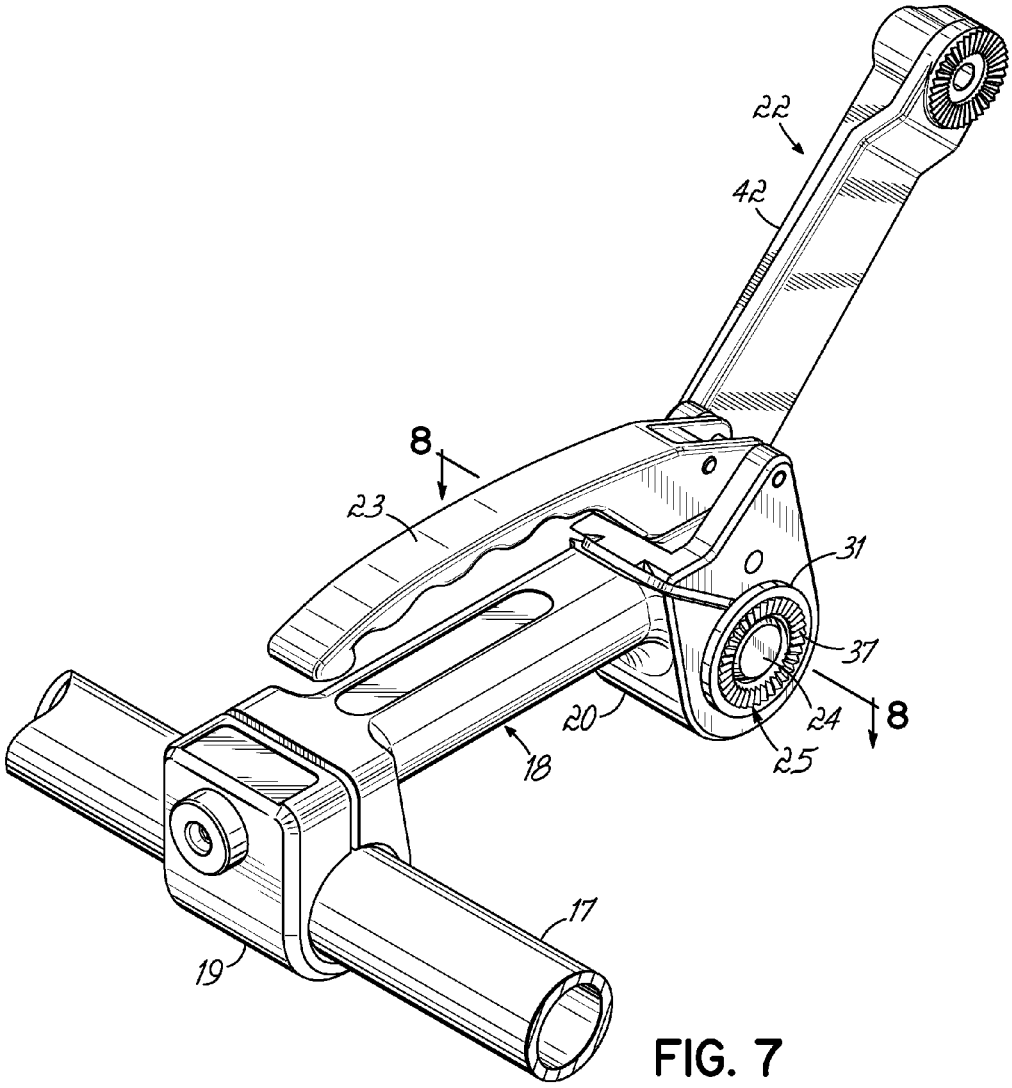
FIG. 7 is a perspective view, similar to FIGS. 2-4, and 6, with the sleeve located in the bore of the base unit handle, with the lever closed, and the sleeve interconnecting the intervening member to the base unit handle.
Figure 8:
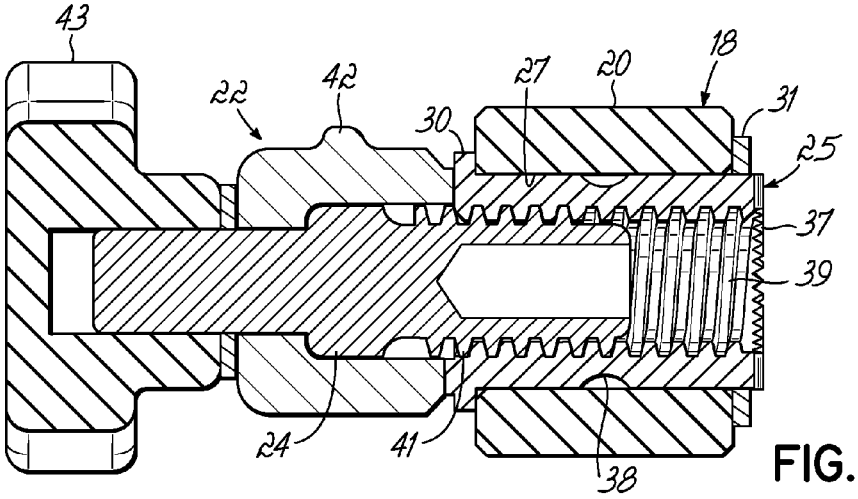
FIG. 8 is a longitudinal cross sectional view, taken along lines 8-8 of FIG. 7.

FIGS. 6, 7 and 8 also show that the transition member 22 preferably includes multiple pieces, namely a transition member body 42 and the post 24 that is threadably extendable into the bore 27. The post 24 is threadably extended into the bore 27 by turning a knob 43 located on the opposite side of the transition member body 42, with the knob 43 being connected to, or even an integral part of the post 24. To connect the intervening member 22 on an opposite side of the base unit handle 18, the intervening member 22 is simply positioned so that the post 24 is inserted into the opposite end of the sleeve 25, and the knob 43 turned so as to cause the threads 41 to engage the internal threads 39 from the opposite side.

When the lever 23 is moved to the closed position, the sleeve 25 and the intervening member 22 are held in a secure position relative to the base unit handle 18. Because the intervening member 22 can connect to either side of the sleeve 25, as shown in FIG. 6, this assembly maintains the positioning freedom that is available with conventional patient head support assemblies.

The two opposite ends of the sleeve 25 preferably include a pair of clutch mechanisms 35 and 37, for instance a pair of starburst connectors, to facilitate connection to the intervening member 22 on either side. That is, either of the clutch mechanisms 35 and 37 of the sleeve 25 can provide a secure connection with the complementary teeth of a connector 45 formed on the transition member body 42, to independently secure the sleeve 25 to the intervening member 22 via rotation of the knob 43. Thus, turning the knob 43 causes the threads 41 to engage the threads 39 of the bore 27, and also causes the starburst 45 to connect to either connector 35 or connector 37, depending on which side the transition member 22 is located. This connection prevents relative rotation between the transition member 22 and the sleeve 25. Also, the transition member 22 and the sleeve 25, when secured together, may rotate together within the bore 27 of the base handle unit 18 when the lever 23 is not locked. Thus, this structure serves as a positive clutch, which uses interlocking teeth or lugs to accomplish engagement, rather than a frictional clutch. It is to be understood that a positive clutch in a form other than that which is illustrated herein could also be used in the present invention, In addition, a frictional clutch could be used in the present invention as well.

These Figures illustrate an exemplary embodiment that uses a sleeve 25 with a positive clutch construction, for example, in the form of starburst ratchets 35 and 37, on both ends thereof. The interior of the sleeve 25 has threads 39 to accept the corresponding external threads 41 of the post 24. The exterior surface of the sleeve 25 is fabricated with a specific finish and/or size to allow it to fit closely in the bore 27. The shaft 25 will rotate freely when the lever 23 is unlocked, but will resist rotation when the lever 23 is locked. The sleeve 25 may retain these characteristics even though it is permanently "captured" in the bore 27.

Where appropriate, the sleeve 25 of the present invention could be used for the connection of other components of a patient head support system 10, or even any other medical apparatus or non-medical apparatus. In such instances, a permanently or removably installed sleeve 25 could provide a secure connection of appropriate support components, while reducing the risk of deforming those components. For instance, the incorporation of such a sleeve 25 could be used to provide increased positioning freedom at the connection of a skull clamp or headrest, by allowing non-incremental rotation, whereas a typical swivel adaptor with a starburst connector does not provide non-incremental rotation.

The structure of this invention is more robust and it is easier to manufacture than conventional connection mechanisms for head support systems. The threaded connection of the intervening member 22 to the base unit handle 18 is more forgiving of slight differences in tolerance, due to the material of the sleeve 25. In addition, the structural arrangement of the present invention maintains the flexibility that is currently available with conventional mechanisms, while at the same time being more tolerant of operator mishandling. To some extent, this increased ability to withstand mishandling is due to the fact that the sleeve 25 can remain in the bore 27.

Those skilled in the art will appreciate that these Figures and this detailed description represent one preferred embodiment of the present invention, and that the structures shown and described are susceptible to various modifications and permutations. Accordingly, the appended claims are to be interpreted in light of and understood with respect to the embodiment shown and described. However, the claims are not to be construed as necessarily limited to the specific structure shown and described. Moreover, the recitation in this specification of "objects" of the invention is intended to help explain the story behind this invention. Their inclusion in this specification should not be interpreted to limit the claims, or to mean that any one single claim must be interpreted or construed so as to achieve each and every one of the stated objects.

I claim:

1. A patient head support system for securing the head of a patient relative to a medical table, comprising:

a head support for holding the patient's head;

a base unit mountable to the table, the base unit including a base unit handle having a main body that defines a bore and also having a lever connected thereto, the lever being operable to move relative to the main body between open and closed positions, so as to expand and to contract the bore, respectively;

an intervening member operatively connecting the base unit and the head suppolt, the intervening member including a post adapted to be received and held within the bore; and a sleeve residing within the bore and rotatable with respect thereto when the lever is in the open position, the sleeve adapted to receive the post of the intervening member and to rigidly hold the post in a fixed position when the lever is in the closed position, the sleeve being sized and/or shaped so as to provide some resistance to contraction of the bore during movement of the lever to the closed position, thereby to protect the bore if the lever is inadvertently moved to the closed position when the intervening member is not operatively connected to the base unit.

2. The patient head support system of claim 1 and further comprising:

a threaded connection between the post and the sleeve, such that the post is threadably received within the bore.

3. The patient head support system of claim 2 further comprising:

a clutch-type connection between the sleeve and the intervening member, thereby to enable the transition member to be fixedly connected to the sleeve so that the sleeve and the intervening member are rotatable relative to the bore, and thus rotatable relative to the base unit handle, when the lever is in the open position.

4. The patient head support system of claim 3, the intervening member further comprising:

an intervening member body supporting the post;

a knob operatively connected to the post and rotatable with respect to the intervening member body, such that rotation of the knob causes the post to threadably connect to the sleeve and also to connect the sleeve and the post via the clutch-type connector.

5. The patient head support of claim 1 wherein the intervening member is a transition member or an adapter.

6. The patient head support system of claim 1 wherein the sleeve has a pair of opposite ends, and further comprising:

a retainer located on at least one of the outer ends of the sleeve.

7. The patient bead support system of claim 1 wherein the sleeve further comprises at least one of: stainless steel, aluminum, titanium, and a radiolucent material.

8. The patient head support system of claim 1 wherein the sleeve further comprises a groove circumferentially surrounding the outer surface thereof.

9. A base unit handle for a head support system comprising:

an elongated body having first and second ends and respective first and second openings located at the first and second ends, the first opening being expandable and contractable in dimension to engage a crossbar and the second opening being expandable and contractable in dimension to engage an intervening member;

a lever operatively connected to the elongated body and adapted to move between open and closed positions relative to the body, whereby movement of the lever to the closed position causes at least the second opening to contract; and a cylindrical sleeve removably held within the second opening, the sleeve having an outer dimension generally sized and shaped so as to fit within the second opening and to provide some resistance to contraction of the second opening during movement of the lever to the closed position, thereby to fixedly hold the intervening member.

10. The base unit handle of claim 9 further comprising:

a flange located at a first end of the sleeve; and a retainer removably held at a second end of the sleeve, opposite the first end.

11. The base unit handle of claim 9 further comprising:

the sleeve having an internal surface with an internal thread that is adapted to receive a complementary threaded post of an intervening member.

12. The base unit handle of claim 9 wherein the sleeve further comprises a pair of connectors at opposite ends thereof.

13. The base unit handle of claim 9 wherein the sleeve further comprises at least one of: stainless steel, aluminum, titanium, and a radiolucent material.

14. The patient head support system of claim 9 wherein the sleeve further comprises a groove circumferentially surrounding the outer surface thereof.

15. In a head support system, a connector for interconnecting a base unit handle with an intervening member, the base unit handle including a contractable bore and the intervening member including a post adapted to be held within the bore, the invention comprising:

a cylindrical sleeve having external and internal surfaces, the external surface sized to be releasably held within the bore and the internal surface adapted to releasably hold the post, the sleeve providing resistance to contraction of the bore thereby to protect the base unit handle.

16. The invention of claim 15 further comprising:

internal threads on the internal surface of the sleeve;

a pair of connectors located at opposite ends of the sleeve; and a flange located at an end of the sleeve and a retainer removably held at another end of the sleeve, opposite the flange.

17. The invention of claim 15 wherein the sleeve further comprises at least one of: stainless steel, aluminum, titanium, and a radiolucent material.

18. The patient head support system of claim 15 wherein the sleeve further comprises a groove circumferentially surrounding the outer surface thereof.

19. A method of protecting the bore of a base unit handle of a base unit of a patient head support system, the base unit handle having a main body defining the bore and a lever connected to the main body and movable with respect thereto between open and closed positions relative to the main body, thereby to expand and contract the bore, respectively, comprising:

retaining a sleeve within the bore, the sleeve sized and/or shaped complementary to the bore so as to he held in a relatively close fit but still rotatable with respect thereto when the lever is in the open position, the sleeve having an internal passage adapted to receive an intervening member and to rigidly hold the intervening member relative to the sleeve and to the main body when the lever is in the closed position.

20. The method of claim 19 further comprising;

placing the sleeve within the bore prior to the retaining.

21. The method of claim 19 further comprising:

connecting an intervening member to the sleeve and then rotating the sleeve and the connected intervening member relative to the main body of the base unit handle; and thereafter moving the lever to a closed position relative to the main body, thereby to lock the sleeve and the connected intervening member in a desired position relative to the base unit handle.

22. The method of claim 21 wherein the connecting further comprises:

threading the intervening member into the sleeve and then forming a clutch-type connection between the sleeve and the intervening member.

* * * * *

UNITED STATES PATENT AND TRADEMARK OFFICE

CERTIFICATE OF CORRECTION

PATENT NO. : 8,683,630 B2
APPLICATION NO. : 13/280902
DATED : April 1, 2014
INVENTOR(S) : Sean Rolfes It is certified that error appears in the above-identified patent and that said Letters Patent is hereby corrected as shown below:

In the Specification

Col. 1, line approx. 14-15: "…system suitable for use during neurosurgery, and more particularly, to an improvement…" should read --…system suitable for use during neurosurgery and, more particularly, to an improvement…--.

Col. 4, line approx. 50-51: "…taken along lines 5----5 of FIG 4,…" should read --…taken along line 5—5 of FIG. 4,…--.

Col. 4, line approx. 60-61: "…taken along lines 8----8 of FIG. 7." should read --…taken along line 8—8 of FIG. 7.--.

In the Claims

Col. 7, line 34, CLAIM 1: "…unit and the head suppolt, the…" should read --...unit and the head support, the...--.

Col. 9, line 16, CLAIM 19: "...shaped complementary to the bore so as to he held in a…" should read --…shaped complementary to the bore so as to be held in a…--.

Col. 10, line 4, CLAIM 20: "The method of claim 19 further comprising;" should read --The method of claim 19 further comprising:--.

Signed and Sealed this
Twenty-ninth Day of July, 2014

Michelle K. Lee

Michelle K. Lee
*Deputy Director of the United States Patent and Trademark Office*